United States Patent [19]

Takamatsu

[11] Patent Number: 5,038,582

[45] Date of Patent: Aug. 13, 1991

[54] LIQUID RECEIVER

[75] Inventor: Yoshikazu Takamatsu, Sano, Japan

[73] Assignee: Calsonic Corporation, Tokyo, Japan

[21] Appl. No.: 492,712

[22] Filed: Mar. 13, 1990

[30] Foreign Application Priority Data

Mar. 13, 1989 [JP] Japan ..... 1-27293[U]

[51] Int. Cl.[5] ..... F25B 43/00

[52] U.S. Cl. ..... 62/474; 62/509

[58] Field of Search ..... 62/474, 509

[56] References Cited

U.S. PATENT DOCUMENTS

| | | | |
|---|---|---|---|
| 2,335,694 | 11/1943 | Paquin et al. | 62/509 X |
| 4,577,469 | 3/1986 | Okura | 62/509 X |
| 4,649,719 | 3/1987 | Yanagisawa | 62/509 X |
| 4,934,552 | 6/1990 | Koide et al. | 62/509 X |

FOREIGN PATENT DOCUMENTS

| | | |
|---|---|---|
| 49-19374 | 2/1974 | Japan . |
| 52-110665 | 8/1977 | Japan . |
| 53-38052 | 4/1978 | Japan . |
| 57-26147 | 6/1982 | Japan . |
| 61-159777 | 10/1986 | Japan . |
| 61-203271 | 12/1986 | Japan . |
| 63-315874 | 12/1988 | Japan . |

*Primary Examiner*—Lloyd L. King

*Attorney, Agent, or Firm*—Gordon W. Hueschen

[57] ABSTRACT

A liquid receiver arranged in such a manner that the upper portion of the tank body is arranged to have a large diameter, the lower portion of the same is arranged to have a small diameter, the overall body or the lower portion of the small-diameter portion is tapered off, and a desiccant charging portion is supported by a stepped portion created between the large-diameter portion and the small-diameter portion. Thus, the quantity of the storaged refrigerant can be reduced and the liquid level can be stabilized so that only the liquid refrigerant is allowed to flow and the work for assembling the desiccant charging portion can be performed easily.

7 Claims, 3 Drawing Sheets

LIQUID RECEIVER

BACKGROUND OF THE INVENTION

1. Field of the Invention

The present invention relates to a liquid receiver whose gas-liquid separation function is improved.

2. Description of the Prior Art

In general, a cooling system for automobile has a liquid receiver which receives an excessive quantity of a refrigerant in the cooling cycle, separates gas from liquid and removes water and dust.

A conventional liquid receiver is shown in FIG. 4. A liquid receiver 100A has a tank body 102, the tank body 102 having an upper plate 103 and a lower plate 104 at its upper end and the lower end, respectively. The upper plate 103 is provided with a head portion 105. The tank body 102 is joined to the upper plate 103 and the lower plate 104 and the upper plate 103 is joined to the head portion 105 by proper joining means such as arc welding.

A refrigerant inlet portion 106 and a refrigerant outlet portion 107 are formed in the head portion 105. The refrigerant inlet portion 106 is an L-shaped passage whose an end is communicated with a condenser (omitted from illustration) and another end is communicated with the inner space in the tank body 102. The refrigerant outlet portion 107 is a passage whose an end is communicated with an expansion valve (omitted from illustration) and another end is connected to a refrigerant output pipe 108.

The refrigerant output pipe 108 extends downward until it reaches a position near a bottom 102*a* of the tank body 102. A sight glass 109 is provided at a position above the refrigerant output pipe 108 for the purpose of looking the inside portion of the refrigerant outlet portion 107.

A desiccant charging portion 110 is secured to an intermediate portion of the refrigerant output pipe 108. The desiccant charging portion 110 has support plates 112 and 113 in which a multiplicity of small apertures are perforated. A desiccant 114 and a filter 115 made of glass wool or the like are held between the support plates 112 and 113. The desiccant 114 acts to absorb water contained in the refrigerant, while the filter 115 acts to remove dust therein.

However, the cylindrical tank body 102 of the liquid receiver 100A is formed by joining the upper plate 103 and the lower plate 104 to the two ends of the cylindrical body by proper joining means such as arc welding. Therefore, it is complicate to manufacture the tank body 102 and the number of the components cannot be reduced, causing disadvantages in terms of the reliability in the airtightness performance and the overall cost to be arisen. As a result, a liquid receiver 100B of a type shown in FIG. 5 has been used recently as disclosed in Japanese Utility Application Laid-Open No. 61-203271.

The liquid receiver 100B comprises the cylindrical tank body 102 with a bottom, and the head portion 105 provided in an upper opening 106 of the tank body 102, the head portion 105 and the tank body 102 being coupled to each other by press-fitting means such as caulking.

As a result, the number of the welding portions and that of the components can be reduced. Furthermore, the assembling work can be easily completed, satisfactory reliability in the airtightness performance can be obtained and the overall cost can be reduced.

However, since the above-described liquid receiver 100B is arranged in such a manner that the desiccant charging portion 110 is disposed in the bottom, the gas-liquid mixed refrigerant, which has moved downwards from the refrigerant inlet portion 106, passes through the desiccant charging portion 110 immediately before it is introduced into the refrigerant output pipe 108. Therefore, if the quantity of the charged refrigerant has been reduced therein, the gas refrigerant can be easily introduced into the refrigerant output pipe 108, causing the gas-liquid mixed refrigerant to easily flow out.

FIG. 6 shows a liquid receiver 100C disclosed in U.S. Pat. No. 4,649,719 and arranged in such a manner that the desiccant charging portion 110 is positioned at an intermediate position of the refrigerant output pipe 108. Therefore, the above-described problem in that the gas and liquid are mixed with each other can be satisfactorily overcome. As a result, the desiccant charging portion 110 exhibits the rectification effect so that the level of the storaged liquid refrigerant cannot be disordered by the refrigerant which has moved downwards. Therefore, a stable liquid level can be obtained.

The liquid receiver shown in FIG. 4 can exhibit the same effect.

However, since the liquid receiver 100C is arranged in such a manner that the tank body 102 is in the form of a cylinder, the capacity of a space below the desiccant charging portion 110 becomes too large. Therefore, a large quantity of the refrigerant must, of course, be enclosed. Furthermore, if the quantity of the refrigerant in the liquid receiver 100C has been reduced, the stable liquid level can be lowered, causing the above-described gas-liquid mixed refrigerant to be introduced into the expansion valve. As a result, the cooling performance can be deteriorated.

Another problem takes place in that it is difficult to assemble the desiccant charging portion 110 of the liquid receiver 100C and it is difficult to adjust the quantity of the desiccant since the upper and the lower support plates 112 and 113 are fastened to the refrigerant output pipe 108 by proper securing means such as welding or brazing. That is, since the desiccant charging portion 110 is arranged in such a manner that the desiccant is held between the upper and the lower support plates 112 and 113 each of which is secured to the refrigerant output pipe 108, the distance between the two support plates 112 and 113 must be adjusted when the quantity of the desiccant is desired to be adjusted. However, it is extremely difficult for the quantity of the desiccant enclosed to be adjusted by the support plates 112 and 113 which are fastened to the refrigerant output pipe 108 by the securing means such as welding or brazing. Furthermore, it is difficult to enclose and secure the desiccant in the tank.

A liquid receiver 100D has been disclosed in Japanese Utility Application Laid-Open No. 53-38052 in which a desiccant 114 is enclosed in the tank body 102 in such a manner that the tank body 102 is, as shown in FIG. 7, divided into two sections and a pan 116 is provided in the lower section of the thus divided tank body 102 so as to enclose the desiccant 114 on the pan 116.

The liquid receiver 100D is manufactured by the steps of disposing a sleeve 117, through which the refrigerant output pipe passes, in the central portion of the above-described pan 116 so as to be then disposed in the tank body 102, and forming the desiccant charging portion 110. Then, the desiccant 114 is enclosed in the desiccant charging portion 110, and the refrigerant output pipe 108 the upper end of which is integrated with the head portion 105 and to which a cap 118 of the desiccant charging portion 110 is fastened via a rubber bush 119 is passed through the sleeve 117. Then, the rubber bush 119 is fitted in the sleeve 117 so that the liquid receiver 100D is manufactured.

However, when the desiccant 114 is enclosed in the liquid receiver 100D, the desiccant 114 can be unconsciously dropped into the tank body 102 through the sleeve 117. It arise a problem in that the grains of the dropped desiccant 114 hinder the smooth flow of the refrigerant or a problem in that the expansion valve disposed in the lower stream to the drying agent 114 can be clogged with the grains of the dropped desiccant 114 during operating the cooling cycle.

The inventors of the present invention have been making studies for the purpose of overcoming the above-described problems. As a result, a fact was found that the level of the liquid refrigerant storaged in the liquid receiver must be maintained stably and at a high level when the performance of separating gas from liquid is desired to be improved. In particular, in the case where the liquid receiver whose basic structure is arranged in such manner that the desiccant charging portion is disposed in the intermediate portion, the level of the liquid refrigerant may be raised by positioning the portion of the tank body below the desiccant charging portion at a position adjacent to the refrigerant output pipe for the purpose of reducing the space around the refrigerant output pipe. Thus, the inventors have achieved the present invention basing upon the above-described knowledge. Furthermore, another advantage can be obtained from the thus structured present invention in that the necessity of using a large quantity of the Freon gas destructing the ozone layers in the atmospheric air, which has been at issue recently, can be eliminated and the quantity of the refrigerant can thereby be saved.

SUMMARY OF THE INVENTION

An object of the present invention is to overcome the above-described problems experienced with the conventional technologies. In order to achieve the above-described object, there is provided a liquid receiver arranged in such a manner that an upper end opening formed in a cylindrical tank body with a bottom is closed by a head portion, a refrigerant introduced through a refrigerant inlet portion formed in the head portion is passed through a desiccant charging portion disposed at an intermediate position of the tank body, and a liquid refrigerant storaged in a lower portion of the tank body is allowed to flow out from a refrigerant output pipe through a liquid outlet portion formed in the head portion, the liquid receiver comprising: a large-diameter portion which is formed by arranging the upper portion of the tank body; a small-diameter portion which is formed by arranging the lower portion of the same; and a stepped portion formed between the large-diameter portion and the small-diameter portion, the stepped portion supporting the desiccant charging portion. As a result, the refrigerant storaged in the bottom of the tank body cannot be disordered by the gas refrigerant which has moved downwards so that a stable liquid level can be realized and only the liquid refrigerant can flow through the refrigerant output pipe. Furthermore, since the lower portion of the tank body is arranged to be a small diameter and small capacity portion, the stable liquid level can be maintained at a high level even if the quantity of the accumulated refrigerant has been reduced by a certain quantity. Therefore, only the liquid refrigerant can be introduced into the refrigerant output pipe for a satisfactory long time. Furthermore, the work for assembling the liquid receiver can be easily completed since it is necessary for the desiccant charging portion to be simply placed at the stepped portion in the tank body.

DETAILED DESCRIPTION OF THE PREFERRED EMBODIMENT

An embodiment of the present invention will now be described with reference to the drawings.

Figure 1:
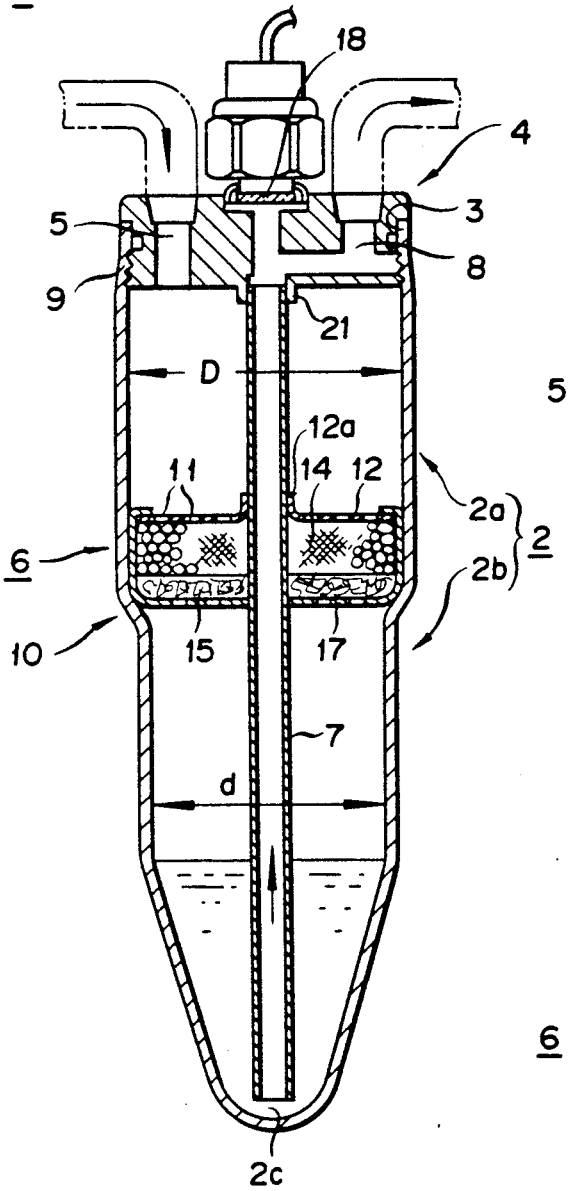
FIG. 1 is a cross sectional view which illustrates an embodiment of the present invention.

Referring to FIG. 1, a liquid receiver 1 comprises a cylindrical tank body 2 with a bottom, and a head portion 4 which covers an opening 3 formed in the upper portion of the tank body 2. A refrigerant which has been introduced through a refrigerant inlet portion 5 formed in the head portion 4 is passed through a desiccant charging portion 6 disposed at an intermediate position of the tank body 2. Then, the refrigerant in the form of liquid is storaged in the bottom portion of the tank body 2. The thus storaged liquid refrigerant is arranged to flow out through a refrigerant outlet portion 8 formed in the head portion 4.

The tank body 2 is made of a material such as aluminum having light weight and capable of being easily formed, the tank body 2 being fastened to the head portion 4 in such a manner that it is engaged to a pit-and-projection portion 9 formed in the periphery of the head portion 4 by proper pressing means such as caulking. The upper portion of the tank body 2 is arranged to be a large-diameter portion **2*a* having a diameter D, while the lower portion of the same is arranged to be a small-diameter portion 2*b* having a diameter d. Furthermore, a stepped portion 10 is formed between the large-diameter portion 2*a* and the small-diameter portion 2*b***.

In air conditioners for usual small size automobiles, the diameter D of the large-diameter portion **2*a* is 55 to 65 cm, while the diameter d of the small-diameter portion 2*b*** is 30 to 60 cm, preferably D 56 cm and d 48 cm.

The lower half portion of the small-diameter portion **2*b* is tapered off so as to reduce the capacity of the tank body 2. That is, the tank body 2 is positioned adjacent to a refrigerant output pipe 7 so as to reduce the capacity around the refrigerant output pipe 7. As a result, the necessary quantity of the refrigerant can be reduced. Furthermore, even if the quantity of the refrigerant has been reduced, the refrigerant, to be sucked upwards through the refrigerant output pipe 7 which projects downwards until it reaches the bottom portion, can be made liquid refrigerant since the height of the stable level of liquid in the tank body 2 can be raised thanks to the arrangement in which the small-diameter portion 2*b*** has been tapered off.

The present invention is not limited to the description about the arrangement in which the lower half portion of the small-diameter portion 2b is tapered off. For example, the overall portion may be tapered off, or the tapering-off may be started at an optional position. The position at which the reduction in the diameter may be optionally determined in accordance with the quantity of the refrigerant to be enclosed.

The desiccant charging portion 6 is formed by utilizing the stepped portion 10 in the tank body 2. The stepped portion 10 acts to assuredly support the desiccant charging portion 6 for the purpose of preventing it from being displaced by the pressure of the refrigerant which has been introduced through the refrigerant inlet portion S.

Figure 3:
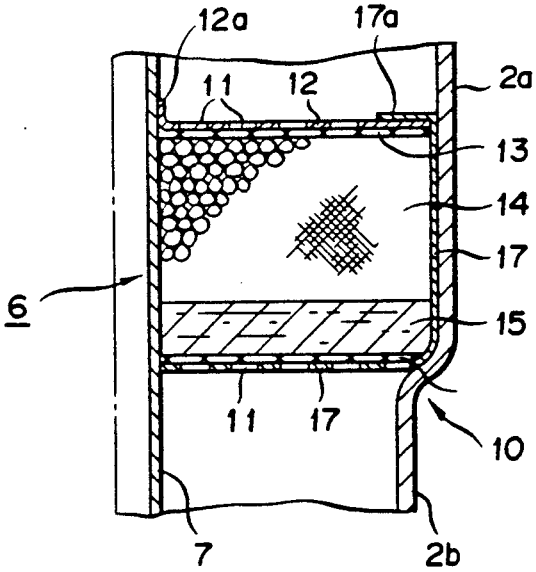
FIG. 3 is an enlarged cross sectional view which illustrates an essential portion of the embodiment shown in FIG. 1.
Figure 4:
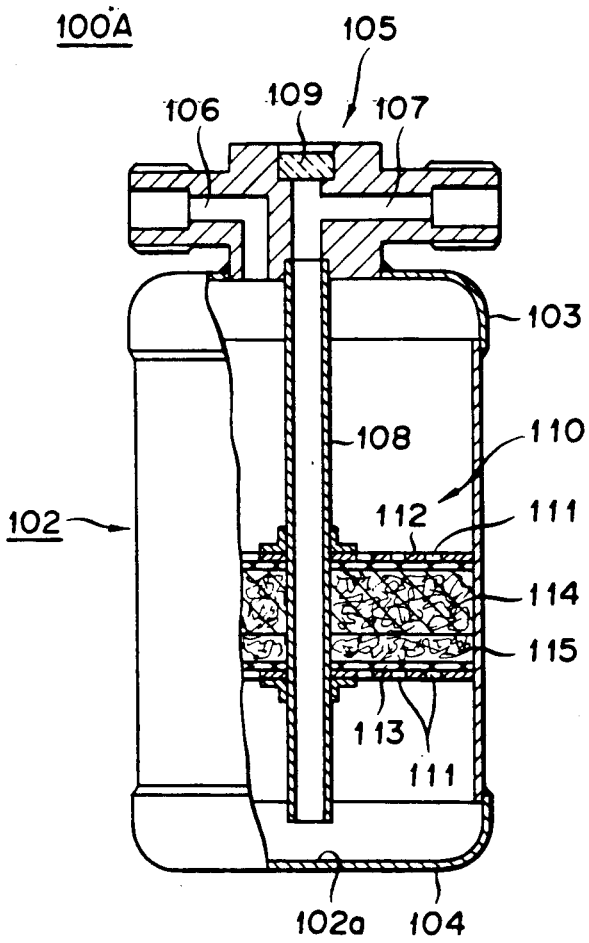
FIG. 4 (Prior Art)
FIGS. 4, 5, 6 and 7 are cross sectional views which illustrate conventional liquid receivers.
Figure 5:
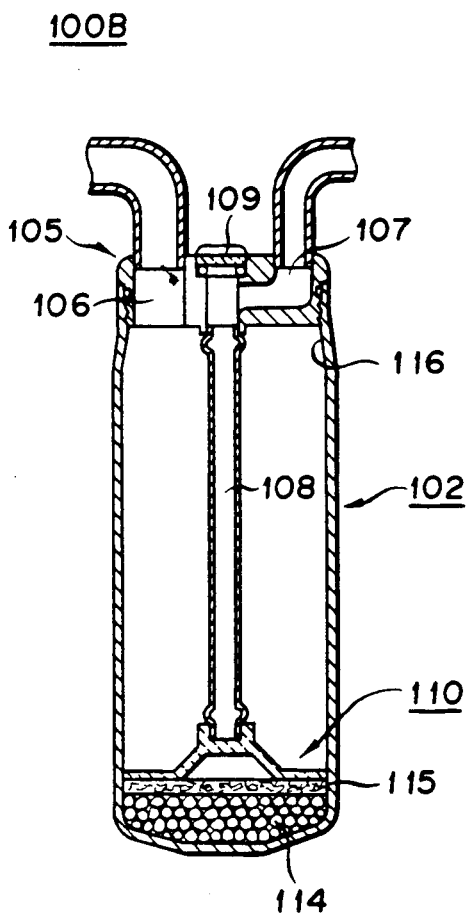
FIG. 5 (Prior Art)
Figure 6:
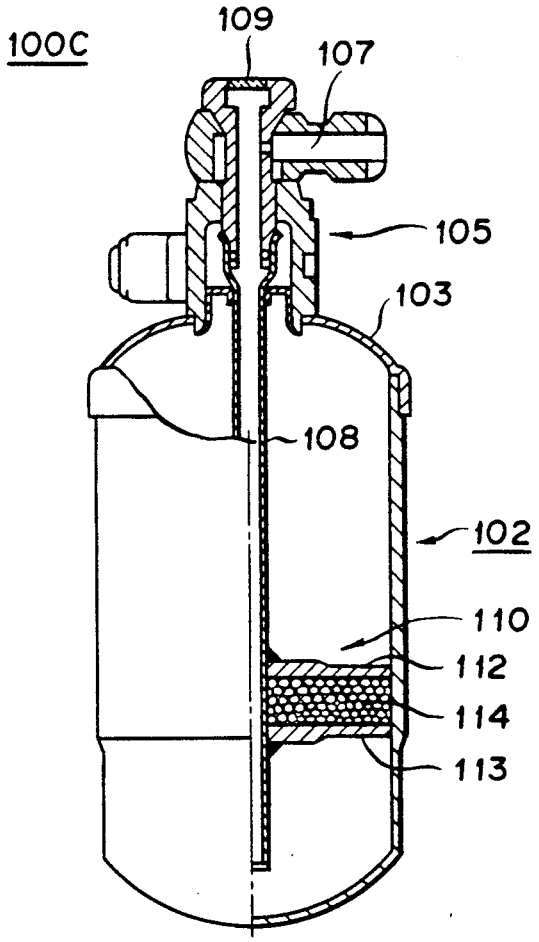
FIG.6 (Prior Art)
Figure 7:
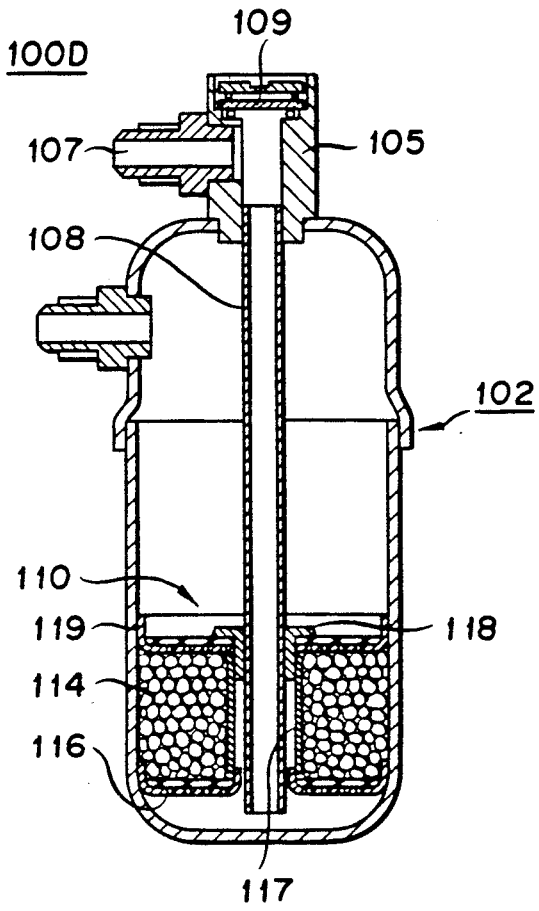
FIG.7 (Prior Art)

As shown in FIG. 3, the desiccant charging portion 6 comprises an upper support plate 12 having a multiplicity of small apertures 11 and secured at an intermediate position of the refrigerant output pipe 7 by means such as welding, a net-shaped upper strainer 13 disposed on the lower surface of the upper support plate 12, a desiccant 14 placed below the upper strainer 13, a filter 15 formed by glass wool, and a lower strainer 16 disposed below the filter 15. All of the above-described components are held and surrounded by a lower support plate 17 having a multiplicity of small apertures 11 and having a U-shaped cross sectional shape. An upper end portion 17a of the lower support plate 17 is bent inwards and is simply placed on the upper support plate 12 so that the lower support plate 17 can be vertically slid with respect to the position of the upper support plate 12. That is, since the lower support plate 17 can be slid with respect to the position of the upper support plate 12, any problem, caused from the adjustment of the desiccant 14 or caused from the position of the secured upper support plate 12 due to the positional relationship with the above-described stepped portion 10, can be prevented.

Figure 2:
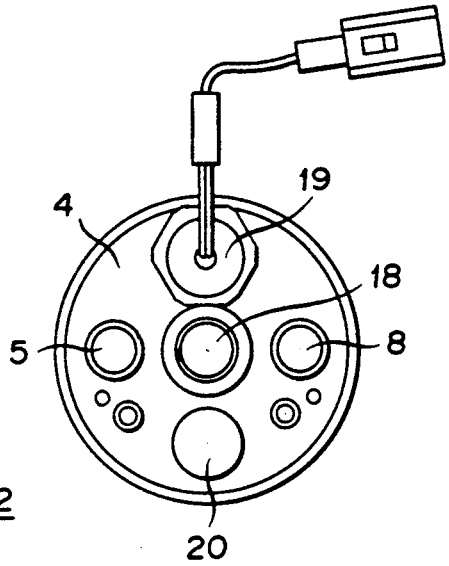
FIG. 2 is a plan view of the same.

As shown in FIG. 2, the head portion 4 fastened to the above-described large-diameter portion 2a comprises the refrigerant inlet portion 5 to which a conduit tube, to be communicated with a condenser, is connected, the refrigerant outlet portion 8 communicated with a conduit tube to be connected to an expansion valve, a sight glass 18 through which the state of the refrigerant passing through the refrigerant outlet portion 8 is observed, a pressure switch 19 for detecting the pressure of the refrigerant in the liquid receiver 1 and a fusible plug 20 which can be fused so as to discharge the refrigerant when the temperature and the pressure of the refrigerant in the liquid receiver has been raised.

The upper surface of the above-described head portion 4 is arranged to be substantially flat. As a result, the vertical dimension of the liquid receiver 1 can be reduced so that it can be readily placed in a narrow engine compartment. The refrigerant output pipe 7 secured to the refrigerant outlet portion 8 is press-fitted into an annular projection 21 formed in the inner periphery of the refrigerant outlet portion 8, the refrigerant output pipe 7 being further projected downwards to a position near a bottom 2c of the tank body 2.

Then, the operation will be described.

When the liquid receiver 1 is assembled, the refrigerant output pipe 7 solely passed through the upper support plate 12. Then, the upper support plate 12 is secured to the substantially intermediate position of the refrigerant output pipe 7 by welding or the like. Another structure may be employed here in which an inner erecting member 12a of the upper support plate 12 is used so as to have the upper support plate 12 simply penetrated by the refrigerant output pipe 7 to an extent in which the upper support plate 12 cannot be easily vertically moved with respect to the position of the refrigerant output pipe 7.

The lower support plate 17 is also penetrated by the above-described refrigerant output pipe 7. Then, the lower strainer 16, the filter 14, the desiccant 14 and the upper strainer 13 are placed in the space surrounded by the lower support plate 17 before the upper end 17a is bent inwards. Then, the lower support plate 17 is hung from the upper support plate 12. The refrigerant output pipe 7 is then press-fitted into the annular projection 21 on the lower surface of the head portion 4.

Then, the head portion 4 and the desiccant charging portion 6 to which the refrigerant output pipe 7 has been fastened are placed in the tank body 2 in such a manner that the desiccant charging portion 6 is disposed on the upper end surface of the stepped portion 10. Then, the upper portion of the tank body 2 is pressed by pressing means such as caulking so as to secure the head portion 4 to the tank body 2 before closing the opening 3. Thus, the assembling process is completed.

Even if a certain quantity of the desiccant 14 to be enclosed is changed or the position at which the above-described upper support plate 12 is displaced to a certain distance during the above-described process, the desiccant charging portion 6 can be assuredly fastened since the lower support plate 17 can be vertically slid with respect to the position of the upper support plate 12. Therefore, no problem arises during the processes of the assembling and the manufacturing of the liquid receiver.

Furthermore, since the welding work can be eliminated except for the portion in which the upper support plate 12 is fastened to the refrigerant output pipe 7, the assembling work can be significantly easily completed.

When the compressor (omitted from illustration) is operated after the thus assembled liquid receiver 1 has been placed in the cooling cycle, the refrigerant which has been condensed by the condenser (omitted from illustration) passes through the cooling pipe, and then introduced into the tank body 2. Water contained in the liquid part of the thus introduced refrigerant is absorbed by the desiccant 14 during its passage and foreign matter in the same is removed by the filter 15. Then, it is storaged in the lower portion which is the small-diameter portion 2c of the tank body 2. Since velocity of the gas part of the refrigerant is reduced during its passage through the desiccant charging portion 6 and it is rectified, the level of the liquid refrigerant storaged in the tank body 2 cannot be disordered. Therefore, a stable liquid level can be obtained.

Even if the quantity of the storaged refrigerant is reduced to a certain quantity in the tank body 2, the stable liquid level can be maintained since the lower half portion of the tank body 2 is formed in a tapered-off shape and the capacity thereof is thereby reduced. Therefore, only the liquid refrigerant can assuredly be introduced into the refrigerant output pipe 7.

As described above, according to the present invention, since the upper portion of the tank body is arranged to have a large diameter, while the lower portion of the same is arranged to have a small diameter, and the desiccant charging portion is supported on the stepped portion disposed between the large-diameter portion and the small-diameter portion, the liquid level of the refrigerant accumulated in the bottom of the tank body can be stabilized and the high and stable liquid level can be maintained even if the quantity of the refrigerant in the system is reduced by a certain quantity. Therefore, substantially only liquid refrigerant is introduced into the refrigerant output pipe. Furthermore, since the structure is arranged in such a manner that the supporting by utilizing the stepped portion is employed and the lower support plate can be slid with respect to the position of the upper support plate, the number of the manufacturing processes such as the assembling of the liquid receiver can be reduced, the airtightness can be improved, and overall cost can be reduced. Furthermore, since the quantity of the refrigerant enclosed in the cooling cycle can be reduced, the present invention contributes to the Freon gas restriction in the atmospheric air.

Although the invention has been described in its preferred form with a certain degree of particularly, it is understood that the present disclosure of the preferred from has been changed in the details of construction and the combination and arrangement of parts may be resorted to without departing from the spirit and the scope of the invention as hereinafter claimed.

I claim:

1. A liquid receiver arranged in such a manner that an upper end opening formed in a cylindrical tank body with a bottom is closed by a head portion, a refrigerant introduced through a refrigerant inlet portion formed in said head portion is passed through a desiccant charging portion disposed at an intermediate position of said tank body, and a liquid refrigerant storaged in a lower portion of said tank body is allowed to flow out from a refrigerant output pipe through a liquid outlet portion formed in said head portion, said liquid receiver comprising:

a large-diameter portion which is formed by arranging the upper portion of said tank body;

a small-diameter portion which is formed by arranging the lower portion of the same, said small-diameter portion being arranged in such a manner that the diameter of the overall body thereof or the lower portion of the same is tapered off; and a stepped portion formed between said large-diameter portion and said small-diameter portion, said stepped portion supporting said desiccant charging portion.

2. A liquid receiver according to claim 1, wherein said desiccant charging portion has an upper support plate secured to said refrigerant output pipe and having a multiplicity of small aperture and a lower support plate fastened in such a manner that said lower support plate can vertically slide with respect to the position of said upper support plate, and at least a desiccant is placed between said two support plates.

3. A liquid receiver according to claim 2, wherein said desiccant charging portion has said upper support plate having said multiplicity of small apertures and said lower support plate having a multiplicity of similar small apertures and a O-shape cross section, whereby an upper strainer, said desiccant, a filter made of glass wool and a lower strainer disposed on the lower surface of said filter are layered between said two support plates.

4. A liquid receiver according to claim 1, wherein said head portion has pits and projections formed on the periphery thereof and said tank body is pressed so as to be engaged with said pits and projections.

5. A liquid receiver according to claim 1, wherein said head portion has a substantially flat upper surface.

6. A liquid receiver according to claim 1, wherein the lower end of said refrigerant output pipe is extended downwards until it reaches a position near a bottom of said small diameter portion which is tapered off.

7. A liquid receiver according to claim 1, wherein the upper end of said refrigerant output pipe is inserted into an annular projection projecting over the lower surface of said head portion.

* * * * *

UNITED STATES PATENT AND TRADEMARK OFFICE

CERTIFICATE OF CORRECTION

PATENT NO. : 5,038,582

DATED : Aug. 13, 1991

INVENTOR(S) : Yoshikazu Takamatsu

It is certified that error appears in the above-identified patent and that said Letters Patent is hereby corrected as shown below:

Column 1, line 19; "T02" should read -- 102 --.
Column 1, line 26; "whose an end" should read -- whose end --.
Column 1, line 29; "whose and end" should read -- whose end --.
Column 1, approximately line 36; "looking the inside" should read -- looking at the inside --.
Column 1, approximately line 53; "complicate" should read -- complicated --.
Column 1, approximately line 57; "to be arisen." should read -- to increase. --.
Columns 3, line 13; "It arise a problem" should read -- Problems arise --.
Column 3, line 15; "or a problem in that" should read --or in that--.
Column 4, line 7; "satisfactory" should read -- satisfactorily --.
Column 4, line 66; "raised thanks" should read -- raised, thanks--.
Column 5, line 16/17; "portion 6 comprises an" should read -- portion 6 is comprised of an --.
Column 7, line 19; "particularly," should read -- particularity,--.
Column 7, line 21; "from" should read -- form --.
Column 8, line 21; "a O-shape" should read -- an O-shape --.

Signed and Sealed this

Sixteenth Day of March, 1993

*Attest:*

STEPHEN G. KUNIN

*Attesting Officer*

*Acting Commissioner of Patents and Trademarks*